United States Patent [19]

Guse et al.

[11] 4,254,995

[45] Mar. 10, 1981

[54] PROCESS OF AND AN ARRANGEMENT FOR MINING

[75] Inventors: Kuno Guse, Dortmund; Josef Schmitjans, Bochum, both of Fed. Rep. of Germany

[73] Assignee: Bochumer Eisenhutte Heintzmann GmbH & Co., Bochum, Fed. Rep. of Germany

[21] Appl. No.: 18,672

[22] Filed: Mar. 8, 1979

[30] Foreign Application Priority Data

Mar. 25, 1978 [DE] Fed. Rep. of Germany ..... 2813142

[51] Int. Cl.[3] ..... E21C 27/16; E21C 37/06

[52] U.S. Cl. ..... 299/17; 299/34; 299/81; 175/67

[58] Field of Search ..... 299/17, 34, 81; 175/67

[56] References Cited

U.S. PATENT DOCUMENTS

| | | | |
|---|---|---|---|
| 3,273,940 | 9/1966 | Belugou | 299/81 |
| 3,542,142 | 11/1970 | Hasiba et al. | 175/67 |
| 3,544,166 | 12/1970 | Proctor | 299/81 |
| 3,865,202 | 2/1975 | Takahashi et al. | 299/81 X |
| 4,070,064 | 1/1978 | Cobb et al. | 299/81 |

FOREIGN PATENT DOCUMENTS

| | | | |
|---|---|---|---|
| 672336 | 5/1952 | United Kingdom | 299/17 |
| 495437 | 3/1976 | U.S.S.R. | 299/81 |

*Primary Examiner*—Ernest R. Purser

*Attorney, Agent, or Firm*—Michael J. Striker

[57] ABSTRACT

A cutting tool has a cutting edge for cutting into a surface of material to be mined so that fissures develop in the region of the bottom of the cut. The cutting tool is provided with apertures adjacent said cutting edge. High pressure fluid medium jets are directed through the apertures in the cutting tool adjacent the cutting edge thereof and against the bottom of the cut so that such jets can enter into the fissures.

22 Claims, 7 Drawing Figures

PROCESS OF AND AN ARRANGEMENT FOR MINING

BACKGROUND OF THE INVENTION

The present invention relates to methods of and arrangements for mining.

More particularly, the present invention concerns methods of and arrangements for extraction of minerals such as rock, coal, etc. in mining galleries.

It is known in the prior art to use for extraction purposes a mechanical cutting tool (i.e. chisel) together with high pressure fluid medium jets. The fluid medium jets are directed in the cutting direction of the cutting tool and more or less normal to a surface of material to be mined. The cutting tool has a cutting edge for cutting into the material to be mined. The fluid medium jets are so guided as to exit the arrangement in the region adjacent to the cutting edge of the cutting tool.

It has been recognized that the extraction productivity of the cutting tool with the high-pressure fluid medium jets is considerably superior to that of the cutting tool without the high-pressure fluid medium jets.

At the same time, the use of the fluid medium considerably increases the service life of the mechanical cutting tool per se. In other words, the fluid medium reduces the abrasion (i.e. wear) of the cutting tool.

During the extraction process, the cutting edge of the cutting tool cuts into a surface of material to be mined so that small fissures develop in the bottom of the cut. The high pressure fluid medium jets are directed (with an extremely high kinetic energy) against the surface to be cut so that the fluid jets enter the small fissures. Due to the extremely high pressure the fluid jets function as a "hydraulic wedge" inserted into the fissures. Thus, the fluid jets considerably increase the depth of the fissures. Obviously, the penetration of the mechanical cutting tool in the surface to be cut is facilitated, since the actual resistance of the material against penetration is reduced. The high pressure fluid medium (e.g. the pressure is up to many thousand bars) continuously flushes the material particles outwardly away from the cut (i.e. fissures) so as to clean the passage for the cutting tool.

The fluid medium cools the cutting tool during the extraction process, which fact considerably increases te service life of the cutting tool. In fact, the fluid medium reduces the temperature of the cutting edge when the latter cuts the surface of the material to be mined. Such an intensive cooling affect reduces the abrasion of the cutting edge even if the extraction process is conducted in a very hard and abrasive material.

The method of mining is not limited only to the mining galleries (however, it is considered to be the most advantageous use) where the cutting is conducted along a predetermined profile (i.e. so-called "contour cutting") which is determined by the cross-section of the gallery. The same method may be used for extraction of the minerals by way of scraping the surface of material to be mixed. This is especially advantageous in the case of coal mining by means of planning tools or coal augers.

The known methods of and arrangements for mining are not satisfactory with respect to the requirements made to reliability and quality of mining under various circumstances and conditions. The penetration of the fluid medium into the material to be cut is not satisfactory, for example if the fluid medium jets are directed as extremely thin streams (e.g. of an outlet diameter of the jet constitutes 0.2–0.8 mm and the pressure of the fluid medium jet is 3500 bars) and of the cutting speed of the cutting tool is inadequately increased. It is especially true when the material to be mined constitutes a very hard substance. However, should the cutting speed be correspondingly reduced, then the penetration of the fluid medium jets may be increased, depending on the resistance of the actual material against the penetration, up to 30 mm. Nevertheless, the cutting speed of 0.2 m/s appears in most cases somewhat too small in order to obtain the best possible use of the arrangement.

SUMMARY OF THE INVENTION

It is a general object of the present invention to avoid the disadvantages of the prior art arrangements for and methods of mining.

More particularly, it is an object of the present invention to provide an arrangement for mining which under other similar conditions has a comparatively higher extraction productivity as opposed to that of the prior art arrangements for mining.

Another object of the present invention is to provide an arrangement for mining which has a considerably increased cutting speed as compared to that of the prior art arrangements for mining.

In pursuance of these objects and others which will become apparent hereafter, one feature of the present invention resides in providing a method of mining, comprising the steps of cutting with a cutting edge of a cutting tool into a surface of material to be mined whereby fissures develop in the region of the bottom of the cut and directing through apertures in the cutting tool adjacent said cutting edge jets of high pressure fluid medium against said bottom of the cut so that such jets can enter into said fissures.

Another advantageous feature of the present invention resides in providing an arrangement for mining, comprising a cutting tool which has a cutting edge for cutting into a surface of material to be mined whereby fissures develop in the region of the bottom of the cut. The cutting tool is provided with apertures adjacent said cutting edge. There are further provided means for directing through said apertures in said cutting tool jets of high pressure fluid medium against said bottom of the cut so that such jets can enter into said fissures.

Thus, due to so-called "hydraulic wedge" effect the fluid medium jets, upon entering into the relatively small fissures in the surface of material to be mined, considerably increase the depth of these fissures. Obviously, this fact facilitates the mining process per se. Since the resistance against the penetration of the material to be mined is reduced it is possible on the one hand, to obtain the same extraction productivity consuming less power, or, on the other hand, to increase the extraction productivity without increasing the power consumption.

Since the high pressure fluid medium jet is directed from the area adjacent to the cutting edge of the cutting tool against the bottom of the cut, rather than just against the working surface of the material to be mined, it becomes possible to use the cutting tool with a relatively large depth of cut. Obviously, this fact considerably increases the extraction productivity of the arrangement.

The high pressure fluid medium effectively removes the separated particles of the material to be mined outwardly away from the cut, thus the friction engagement between the cutting tool (i.e. cutting edge of the cutting tool) and the separated material is considerably decreased. This fact leads to decreasing the heating of the cutting edge of the cutting tool, which heating is otherwise rather significant. Besides, the high pressure fluid makes the active cooling of the cutting edge of the cutting tool more intensive. Even disregarding the fact that the high pressure fluid medium exits the apertures at the cutting edge immediately adjacent to the working region of the cutting tool (i.e. the region which obviously has the highest temperature development) the cooling effect of the high-pressure fluid medium on the cutting edge itself is very significant since the fluid medium substantially surrounds the cutting edge of the cutting tool in the region of the cut. This direct intensive cooling of the cutting tool (i.e. of the cutting edge of the cutting tool) renders it possible, even in the case where an extremely hard material is mined, to considerably reduce the abrasion of the cutting edge and consequently significantly increase the service life of the cutting tool as opposed to that of the prior art cutting tools.

In accordance with the present invention, the cutting tool includes a chisel and chisel holder. The chisel holder is provided with a plurality of nozzles which are spread in a direction of the breadth of the chisel. It is also possible to locate the nozzles in a direction of the length of the chisel. The nozzles are spaced one from another by a predetermined distance. Each nozzle has an outlet open into a corresponding recess or groove which is provided on the chisel. Each nozzle has a longitudinal axis which extends through the respective groove in the chisel and at an angle relative to the bottom surface of the art. The bottom surface is parallel to the face surface of the mining gallery. The longitudinal axis of each nozzle intersects the extension of the bottom surface of the cut at a point immediately in front of the cutting edge of the cutting tool if viewed in the direction of mining. The groove has a cross-sectional dimension exceeding that of the outlet of the respective nozzle.

In the preferred embodiment of the present invention the angle between the longitudinal axis of the nozzle and the bottom surface of the cut to be made is below 20° and preferably between 5° and 15° (i.e. the maximum).

The longitudinal axes of at least some nozzles are oriented parallel to the cutting direction of the cutting tool. If desired, the longitudinal axes of two nozzles—these nozzles being outwardly located on the cutting tool as considered in the direction of the breadth of the cutting tool—can be outwardly inclined at an angle (i.e. acute angle) relative to the cutting direction of the cutting tool.

It is preferable to so incline the longitudinal grooves (communicating with the respective nozzle outlets) in the chizel that the lower open ends of these grooves are located immediately adjacent to the cutting edge of the cutting tool. In other words, it is essential to arrange the lower open ends of the grooves as close to the cutting edge (which faces the bottom surface of the cut to be made) as possible. Thus, the fluid medium jets exiting the nozzle outlets are guided by the respective longitudinal grooves towards the cutting edge of the chisel. The fluid medium jets exit the respective open ends of the longitudinal grooves practically adjacent to the cutting edge of the chisel.

The chisel may include a hard metal insert plate, e.g. carbide cutting tool. In this case, the hard metal insert plate is provided with a number of longitudinal passages. Each passage has one end communicating with the respective nozzle outlet, and another end open outwardly and located immediately adjacent to the cutting edge of the plate.

The hard metal insert plate may consist of a number of separate parts which when in assembly on the chisel holder constitute between each two adjacent parts a longitudinal recess. The nozzle outlets are open in the respective longitudinal recesses. The recesses extend along the insert plate (i.e. chisel) towards the cutting edge thereof. Thus, the fluid medium jets exit the nozzles into the respective longitudinal recesses. The longitudinal recesses guide the fluid medium jets right to the cutting edge of the hard metal insert plate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
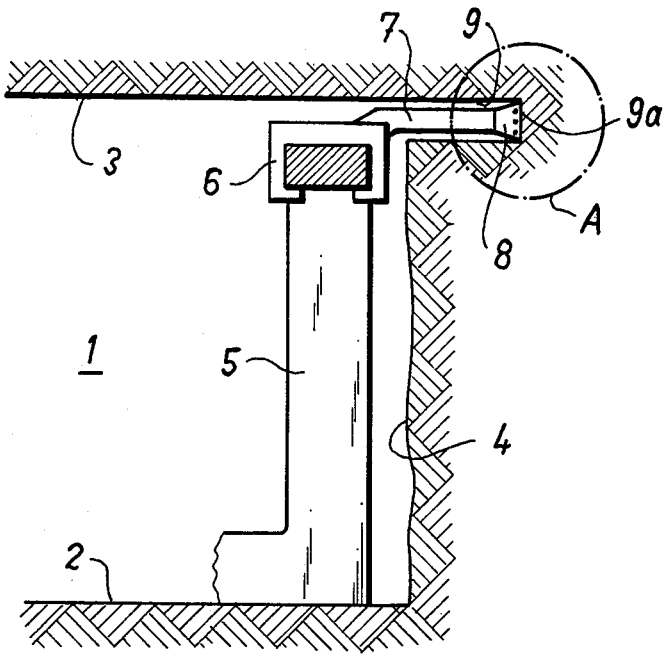
FIG. 1 is a vertical sectional view of a drift gallery with an arrangement for mining in the gallery in accordance with the present invention.
Figure 2:
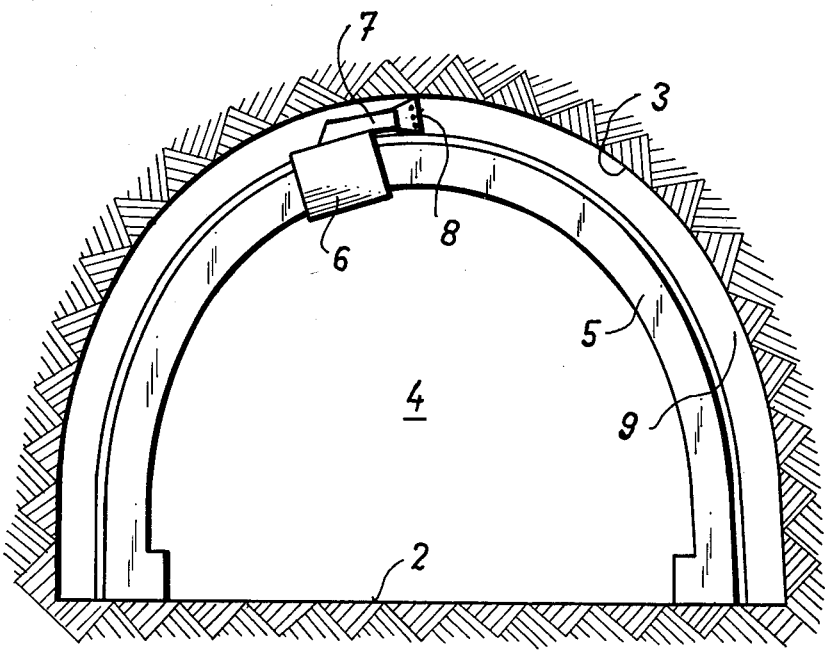
FIG. 2 is a sectional view of the drift shown in FIG. 1.

Referring now to the drawings and first to the FIGS. 1 and 2 thereof, it may be seen that the reference numeral 1 designates a mining gallery (i.e. a drift) of material to be mined. The drift 1 has a lower surface 2, a roof surface 3 and a face surface 4.

The drift 1 is cut along a profile by a cutting tool 7 (i.e. a chisel) mounted on a support 6 which is shiftable in a circumferential direction of the drift 1 on a guiding arm 5. The cutting tool 7 cuts a cut 9 (i.e. groove) in the face surface 4 of the drift 1.

Figure 4:
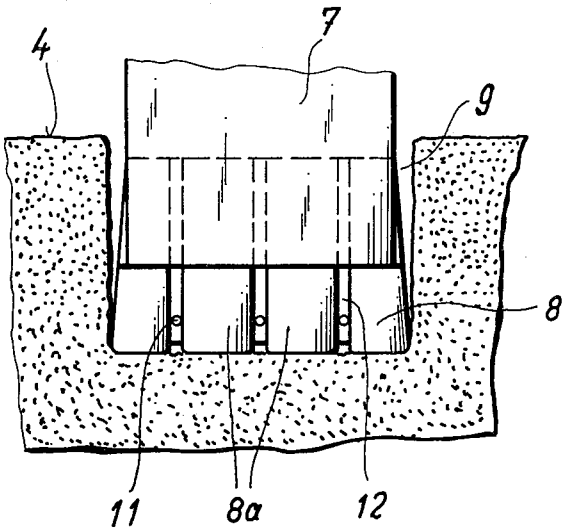
FIG. 4 is a front view of the portion A of the arrangement shown in FIGS. 1 and 3.
Figure 3:
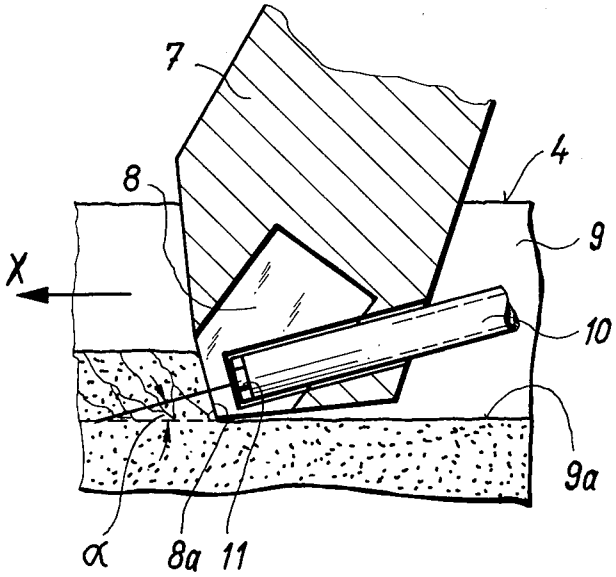
FIG. 3 is a longitudinal sectional view of a portion A of the arrangement shown in FIG. 1, shown on an enlarged scale.

FIGS. 3 and 4 illustrate a portion A (shown in FIG. 1) of the combined tool 7 on an enlarged scale.

A cutting tool holder 7 is provided at the lower front (as viewed in the direction of an arrow X) portion thereof with a chisel 8. The lower rear portion of the holder 8 (i.e. the portion which faces the bottom surface 9*a* of the cut 9) is provided with a recess (or recesses) for accommodating therein a plurality of nozzles 10 each having a nozzle outlet 11 which faces towards a front end face 8*a* of the chisel 8. The nozzle outlets 11 are open into respective grooves 12 (see FIG. 4) which have a cross-sectional dimension bigger than that of the nozzle outlet 11. The nozzles 10 are spaced one from another in the direction of the breadth of the chisel 8. Each nozzle 10 has a longitudinal axis which is inclined relative to the bottom surface 9*a* (which is parallel to the face surface 4) of the cut 9 at an angle $\alpha$ which is equals 12°. The longitudinal axes of the nozzles 10 intersect the extension of the bottom surface 9*a* of the cut 9 at a point immediately in front of the cutting edge of the diesel 8.

The arrow X designates the direction of movement of the cutting tool, in other words the cutting direction.

The vertical grooves 12 may be constituted by corresponding gaps between the side faces of the separate insert plates of a hard metal (see FIG. 4).

A feed connection for supplying the high-pressure fluid medium (i.e. water) into the nozzle housing 10 is not shown for the sake of simplicity of the drawing. The water is supplied under a pressure of 2500 bar. The cross-sectional dimension of the nozzle constitutes somewhat between 0.2 and 0.8 mm. Thus, the high-pressure water jet exits the nozzles 10 with a very high kinetic energy. The exiting high-pressure water jets enter the cut 9 in the face surface 4 of the material to be mined. The high-pressure water jets further enter fissures which develop on the bottom 9*a* during cutting the cut 9 with the cutting edge of the cutting tool 7. Due to the high kinetic energy the high pressure water jets exert on the fissures the hydraulic "wedging effect" to thereby increase the fissures further deep into the material to be mined.

Figure 5:
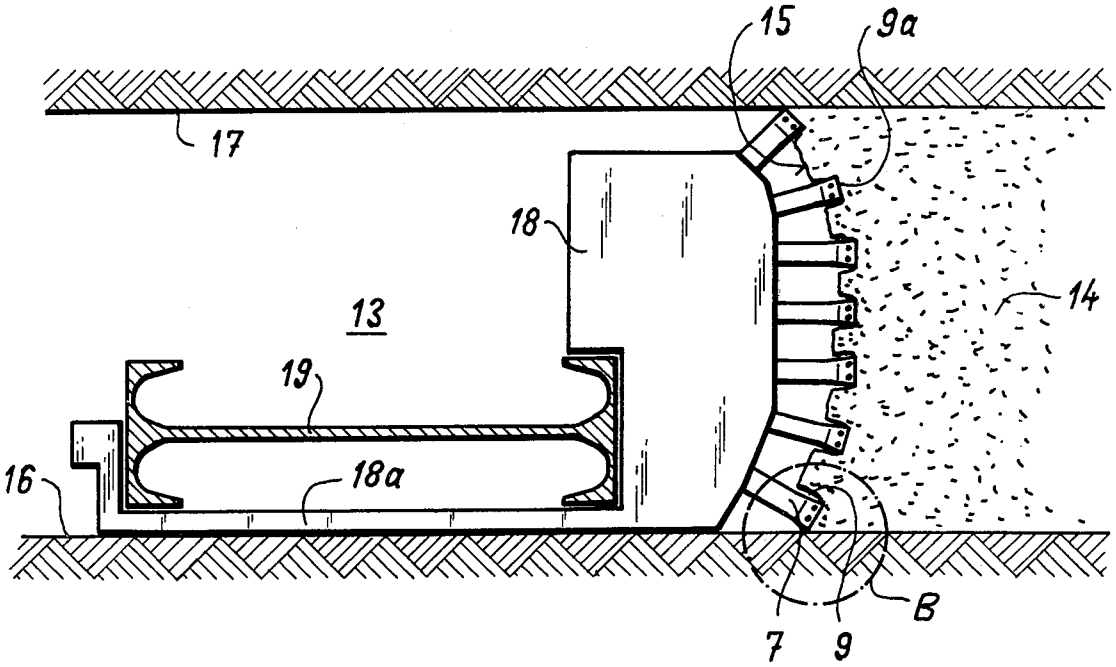
FIG. 5 is a sectional view of a gallery for coal mining by means of the arrangement including a planning tool.

FIG. 5 shows a drift, designated by the reference numeral 13, for excavating coal stratum or the like, designated by the reference numeral 14. The face of the coal drift 13 is designated by the reference numeral 15; the lower surface is designated by the reference numeral 16; and the roof surface of the coal drift is designated by the reference numeral 17. The coal is excavated in response to movement of cutting tool support 18 which is supported from the rear side thereof by a transporter 19. The transporter 19 is surrounded by a part 18*a* of the support 18.

The cutting tool support 18 is provided with a plurality of combined cutting tools which engage the face surface 15 of the coal stratum 14. Each combined tool 7 includes a chisel 8 with the high-pressure water jet nozzles 10 and 11.

Each cutting tool 7 cuts in the coal stratum 14 a cut 9 by way similar to that explained with reference to FIGS. 1 and 2. The bottom of the cut 9 in the case of the embodiment shown in FIG. 5 is designated by the reference numeral 9*a*.

The hard metal insert plate 8 is of one piece (see FIGS. 6 and 7) and is provided with a plurality of throughgoing passages 20. The nozzle outlets 11 are open in the respective passages 20. The passages 20 may have the cross-sectional dimensions slightly exceeding that of the nozzle outlet 11. The other open end of each passage 20 communicates with the exterior of the chisel 7.

Such an arrangement renders it possible to arrange the passages 20 so that the other open ends thereof are located directly on the cutting surface 8 (i.e. cutting edge 8*a*) of the cutting tool 7.

Figure 6:
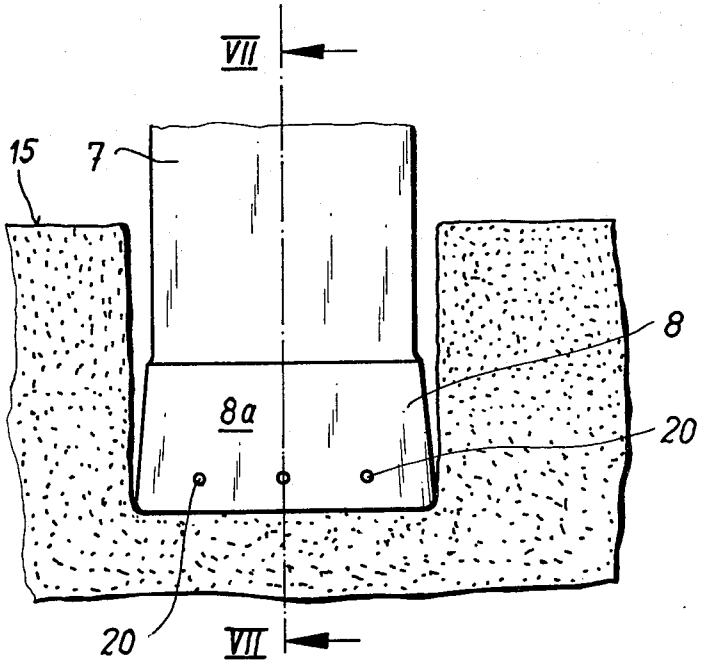
FIG. 6 is a front view of a portion B of the arrangement shown in FIG. 5 shown on an enlarged scale.
Figure 7:
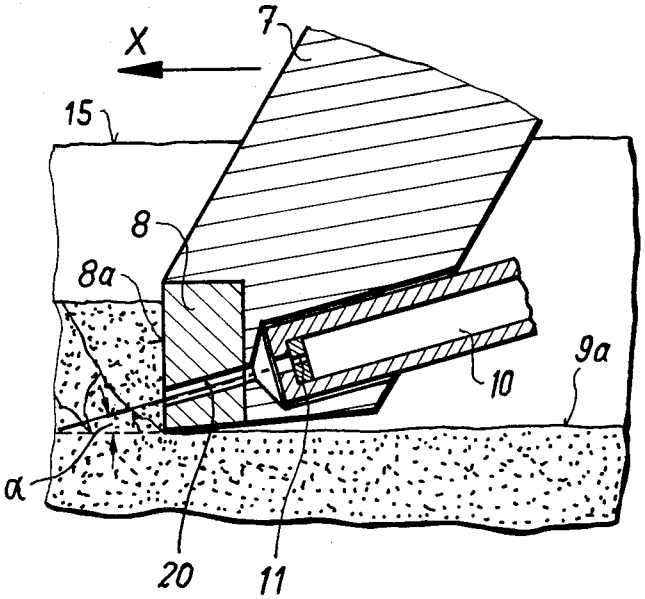
FIG. 7 is a longitudinal sectional view taken along the line VII—VII in FIG. 6.

The embodiment shown in FIG. 6 has three passages 20. However, it is to be understood that there may be provided a greater or a smaller number of passages 20.

The embodiment shown in FIG. 6 has only one row of passages 20. There may be provided a few such rows of passages 20. However, as a rule, it is quite sufficient to arrange the passages 20 in one row.

It will be understood that each of the elements described above, or two or more together, may also find a useful application in other types of arrangements for and methods of mining differing from the types described above.

While the invention has been illustrated and described as embodied in an arrangement for and a method of mining, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A process of mining, comprising the steps of cutting with a cutting edge of a cutting tool into a surface of material to be mined whereby fissures develop in the region of the bottom of the cut; and directing through apertures in the cutting tool adjacent said cutting edge jets of high pressure fluid medium forming an angle between 5–20 degrees with said bottom of the cut so that such jets enter onto said fissures and act as hydraulic wedges.

2. A process as defined in claim 1; and further comprising the step of providing a cutting tool with a plurality of passages each having one end open immediately adjacent to said cutting edge of said cutting tool.

3. A process as defined in claim 2; and further comprising the step of arranging high-pressure fluid medium nozzles open respectively into said passages.

4. A process as defined in claim 2; and further comprising the step of so arranging said passages that said jets enter right into said cut in the surface of material to be mined.

5. A process as defined in claim 1; and further comprising the step of increasing the depth of said fissures in the region of the bottom of the cut only due to the high kinetic energy of the high-pressure fluid medium jets entered into said fissures.

6. A process as defined in claim 1; and further comprising the step of flushing separated particles of the material to be mined outwardly away from said cut by means of said high-pressure fluid medium jets directed into said cut.

7. A process as defined in claim 1; and further comprising the step of cooling said cutting edge of the cutting tool during the mining process.

8. An arrangement for mining, comprising a cutting tool having a cutting edge for cutting into a surface of material to be mined whereby fissures develop in the region of the bottom of the cut; said cutting tool being provided with apertures adjacent said cutting edge; and means for directing through said apertures in said cutting tool jets of high-pressure fluid medium forming an angle between 5–20 degrees with said bottom of the cut so that such jets can enter into said fissures and act as hydraulic wedges.

9. An arrangement as defined in claim 8 said cutting tool includes a cutting element provided with a plurality of throughgoing passages each having one end open immediately adjacent to the cutting edge of the cutting tool and another end, and a holder for holding said cutting element having a recess communicating with said other end of said passages.

10. An arrangement as defined in claim 9, wherein said cutting element is of hard metal.

11. An arrangement as defined in claim 9, wherein said cutting element is of one piece.

12. An arrangement as defined in claim 9, wherein said directing means include a plurality of high-pressure fluid medium nozzles located in said recess of said holder and each having a nozzle opening respectively communicating with said other end of said passages.

13. An arrangement as defined in claim 12, wherein said cutting element has a front surface facing said surface of material to be mined, said one end of each of said passages being open onto said front surface of said cutting element.

14. An arrangement as defined in claim 13, wherein said front surface of said cutting element is provided with a plurality of elongated grooves, said grooves communicating with the respective nozzles mounted on said holder.

15. An arrangement as defined in claim 14, wherein each groove has a cross-sectional dimension substantially exceeding that of the respective nozzle outlet.

16. An arrangement as defined in claim 14, wherein said grooves extend substantially lengthwise of said cutting element and having one end portion open immediately adjacent said cutting edge.

17. An arrangement as defined in claim 16, wherein said one end portion of said grooves is open slightly above said cutting edge of said cutting element.

18. An arrangement as defined in claim 14, wherein each nozzle has a longitudinal axis, at least some of said nozzles being so arranged on said holder that the longitudinal axes of said some nozzles extend substantially parallel to a cutting direction of said cutting element.

19. An arrangement as defined in claim 18, wherein said some nozzles are so arranged on said holder that the longitudinal axes of said some nozzles intersect the extension of the bottom surface of the cut at a point immediately in front of the cutting edge of the cutting tool.

20. An arrangement as defined in claim 14, wherein said cutting element includes a number of separate parts so arranged relative to each other as to constitute together said cutting element.

21. An arrangement as defined in claim 20, wherein said separate parts of said cutting element are so arranged in said holder as to constitute said plurality of grooves between the separate adjacent parts when the same are in assembly with the holder.

22. An arrangement as defined in claim 8, wherein said cutting tool is a chisel.

* * * * *